US008576154B2

(12) United States Patent
Kim

(10) Patent No.: US 8,576,154 B2
(45) Date of Patent: Nov. 5, 2013

(54) DISPLAY DEVICE HAVING DUMMY GATE LINE FOR A UNIFORM BRIGHTNESS

(75) Inventor: Do Sung Kim, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 1116 days.

(21) Appl. No.: 11/966,656

(22) Filed: Dec. 28, 2007

(65) Prior Publication Data

US 2008/0158124 A1 Jul. 3, 2008

(30) Foreign Application Priority Data

Dec. 28, 2006 (KR) ..... 10-2006-0136098

(51) Int. Cl.
*G09G 3/36* (2006.01)

(52) U.S. Cl.
USPC ..... 345/98

(58) Field of Classification Search
USPC ..... 345/92–93, 98–100, 87, 77, 204, 214
See application file for complete search history.

(56) References Cited

U.S. PATENT DOCUMENTS 5,598,178 A * 1/1997 Kawamori ..... 345/93
5,877,736 A * 3/1999 Imajo et al. ..... 345/89
6,169,530 B1 * 1/2001 Mori et al. ..... 345/93
2002/0093474 A1 * 7/2002 Toyoshima et al. ..... 345/87
2003/0189685 A1 * 10/2003 Choi et al. ..... 349/149
2004/0155851 A1 * 8/2004 Morii ..... 345/99
2007/0085798 A1 * 4/2007 Hashimoto et al. ..... 345/93
2007/0115235 A1 * 5/2007 Park ..... 345/93
2007/0164948 A1 * 7/2007 Kim et al. ..... 345/87

FOREIGN PATENT DOCUMENTS

KR 2002-0057225 A 7/2002
KR 2003-0083309 A 10/2003

* cited by examiner

*Primary Examiner* — Liliana Cerullo
(74) *Attorney, Agent, or Firm* — Birch, Stewart, Kolasch & Birch, LLP

(57) ABSTRACT

A display apparatus is provided. The display apparatus according to an embodiment of the present invention includes: a plurality of gate lines formed extending in a first direction of a lower substrate and spaced apart by an equal interval along a second direction of the lower substrate; a dummy gate line formed below the last gate line in the second direction; a plurality of data lines formed extending in the second direction and spaced apart by an equal interval along the first direction; a plurality of pixels formed at crossing portions of the plurality of gate lines and the plurality of data lines, each pixel having a thin film transistor and a storage capacitor; and a gate drive unit disposed outside the lower substrate, and electrically connected to the plurality of gate lines and the dummy gate line to deliver a gate signal for turning on/off the thin film transistor.

7 Claims, 5 Drawing Sheets

DISPLAY DEVICE HAVING DUMMY GATE LINE FOR A UNIFORM BRIGHTNESS

CROSS-REFERENCE TO RELATED APPLICATIONS

The present application claims priority under 35 U.S.C. 119 and 35 U.S.C. 365 to Korean Patent Application No. 10-2006-0136089 filed on Dec. 28, 2006, which is hereby incorporated by reference in its entirety.

BACKGROUND

The present disclosure relates to a display apparatus, and more particularly, to a display apparatus that can improve the brightness uniformity by making brightness of pixels connected to a last gate line be equal to that of pixels other than the pixels connected to the last gate line.

With the rapid advance toward an information-oriented society in recent years, there is an increasing need for flat panel displays having superior characteristics, such as slim profile, lightweight, low power consumption, and the like.

Representative examples of such flat panel displays are liquid crystal display devices (LCD), organic light emitting devices, plasma display devices (PDP), and the like. Among those, the LCDs are frequently employed as monitors for notebook computers or desktop computers owing to their superior resolution, color display capability, and picture quality.

The LCD includes a lower substrate on which thin film transistors (TFTs) functioning as switching elements and pixel electrodes are formed, an upper substrate on which a color filter and a common electrode are formed, and a liquid crystal injected between the lower substrate and the upper substrate and driven by the pixel electrodes and the common electrode to manipulate transmission of light.

The TFTs formed on the lower substrate are connected with gate lines and data lines, and the pixel electrodes are connected with the TFTs. The gate lines are to turn on/off the TFTs for a predetermined time period, and are formed extending in a first direction of the lower substrate, i.e., a horizontal direction. The gate lines are arranged at an equal interval along a second direction of the lower substrate, i.e., a vertical direction. For example, when an LCD has the resolution of 1,024×768, 768 gate lines are arranged in parallel along the second direction of the lower substrate.

The data lines deliver data signals for a time period when the TFTs are turned on, to drive the liquid crystal, thereby charging a storage capacitor. The data lines are formed in the second direction of the lower substrate. The data lines are arranged at an equal interval along the first direction of the lower substrate. For example, when an LCD has the resolution of 1,024×768, 1,024×3 data lines are arranged in parallel.

Thus, pixel regions are defined by Intersecting of the gate lines and the data lines. A TFT and a pixel electrode are disposed on each pixel region.

However, in the case of the related art LCD, to a gate line formed on a last edge of the lower substrate, i.e., $768^{th}$ gate line, a gate turn-on signal is delivered for a time period 1.5 times longer than that applied to other gate lines so as to indicate that the $768^{th}$ gate line is the last gate line. Accordingly, since a charge amount charged in a storage capacitor of a pixel connected with the $768^{th}$ gate line is larger than that charged in a storage capacitor of a pixel connected with other gate line, the brightness of the pixel connected with the $768^{th}$ gate line is higher than that of the pixel connected with other gate line, so that the brightness uniformity decreases.

SUMMARY

Accordingly, the present disclosure is directed to a display apparatus that substantially obviates one or more of the problems due to limitations and disadvantages of the related art.

Embodiments provide a display apparatus that can improve the brightness uniformity by making a charge amount of a storage capacitor of a pixel connected to a last gate line be approximately equal to that of a storage capacitor of a pixel connected to other gate line.

In one embodiment, a display apparatus includes: a plurality of gate lines formed extending in a first direction of a lower substrate and spaced apart by an equal interval along a second direction of the lower substrate; a dummy gate line formed below the last gate line in the second direction; a plurality of data lines formed extending in the second direction and spaced apart by an equal interval along the first direction; a plurality of pixels formed at crossing portions of the plurality of gate lines and the plurality of data lines, each pixel having a thin film transistor and a storage capacitor; and a gate drive unit disposed outside the lower substrate, and electrically connected to the plurality of gate lines and the dummy gate line to deliver a gate signal for turning on/off the thin film transistor.

In another embodiment, a display apparatus includes: a plurality of gate lines formed extending in a first direction of a lower substrate and spaced apart by an equal interval along a second direction of the lower substrate; a plurality of data lines formed extending in the second direction and spaced apart by an equal interval along the first direction; a plurality of pixels formed at crossing portions of the plurality of gate lines and the plurality of data lines, each pixel having a thin film transistor and a storage capacitor; a resistance unit formed on the last gate line arranged along the second direction to control a charge amount of a storage capacitor connected with the last gate line; and a gate drive unit disposed outside the lower substrate, and electrically connected to the plurality of gate lines and the dummy gate line to deliver a gate signal for turning on/off the thin film transistor.

In further another embodiment, a display apparatus includes: a plurality of gate lines formed extending in a first direction of a lower substrate and arranged along a second direction of the lower substrate, the plurality of gate lines having widths decreasing as it travels toward the second direction; a plurality of data lines formed extending in the second direction and spaced apart by an equal interval along the first direction; a plurality of pixels formed at crossing portions of the plurality of gate lines and the plurality of data lines, each pixel having a thin film transistor and a storage capacitor; and a gate drive unit disposed outside the lower substrate, and electrically connected to the plurality of gate lines and the dummy gate line to deliver a gate signal for turning on/off the thin film transistor.

Additional advantages, objects, and features of the disclosure will be set forth in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

It is to be understood that both the foregoing general description and the following detailed description of the present disclosure are exemplary and explanatory, and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

DETAILED DESCRIPTION OF THE EMBODIMENTS

Reference will now be made in detail to the embodiments of the present invention, examples of which are illustrated in the accompanying drawings.

Embodiment 1

Figure 1:
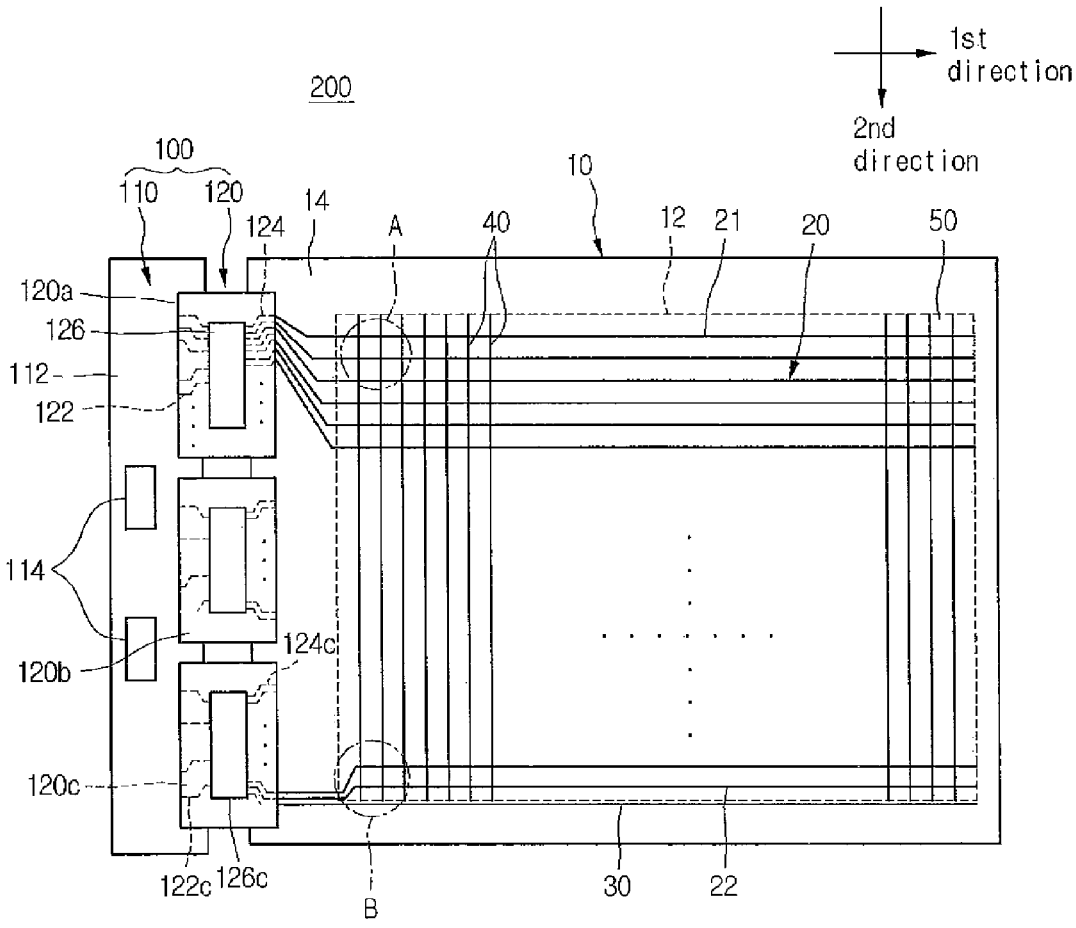
FIG. 1 is a plan view illustrating a lower substrate and a gate drive unit according to a first embodiment of the present disclosure.
Figure 2:
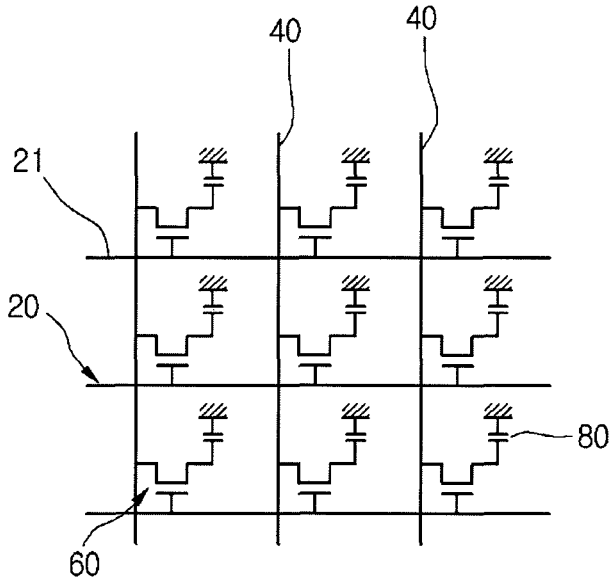
FIG. 2 is a detailed view of a portion 'A' of FIG. 1.
Figure 3:
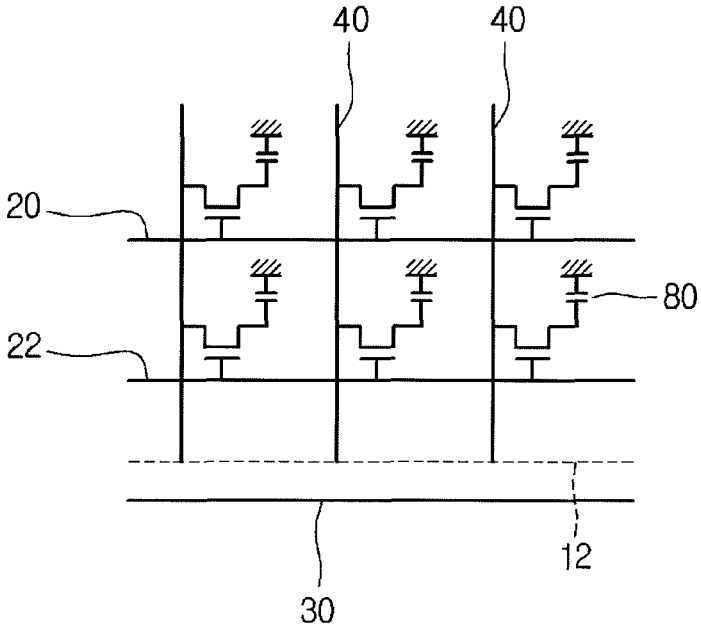
FIG. 3 is a detailed view of a portion 'B' of FIG. 1.

FIG. 1 is a plan view illustrating a lower substrate and a gate drive unit according to a first embodiment of the present disclosure, FIG. 2 is a detailed view of a portion 'A' of FIG. 1, and FIG. 3 is a detailed view of a portion 'B' of FIG. 1.

Referring to FIG. 1, a display apparatus 200 includes a lower substrate 10, an upper substrate, a liquid crystal layer, and a gate drive unit 100. In FIG. 1, only the lower substrate 10 and the gate drive unit 100 in relation to the present embodiment are shown. Hereinafter, the display apparatus according to the embodiment 1 will be described focusing on the lower substrate and the gate drive unit.

Again referring to FIG. 1, the lower substrate 10 is divided into an image display region 12 on which an image is displayed, and a peripheral region disposed at an outside of the image display region, enclosing the image display region 12, and on which an image is not displayed.

On the lower substrate 10 divided as above, gate signal lines 20, a dummy gate line 30, data lines 40, thin film transistors (TFTs) 60, pixel electrodes 70, and storage capacitors 80 are formed.

The gate lines 20 are formed in a first direction of the lower substrate 10, e.g., a horizontal direction such that they pass an entire region of the image display region 12 from the peripheral region 14. The gate lines 20 are arranged in plurality at an equal interval along a second direction of the lower substrate 10, e.g., a vertical direction. In this embodiment, when the display apparatus has the resolution of 1,024×768, 768 gate lines are arranged in parallel along the second direction of the lower substrate 10.

The dummy gate line 30 is disposed below a gate line 22 which is disposed at a last line among the gate lines 20, i.e., below the $768^{th}$ gate line 22. In this embodiment, the dummy gate line 30 is preferably formed on the peripheral region 14.

The data lines 40 are formed crossing the gate lines 20. The data lines 40 are formed in the second direction of the lower substrate 20. The data lines are arranged at an equal interval along the first direction of the lower substrate 20. In this embodiment, when the display apparatus has the resolution of 1,024×768, 1,024×3 data lines 40 are arranged in parallel.

Referring to FIGS. 1 to 3, the data lines 40 in this embodiment cross a first gate signal line 21 to the $768^{th}$ gate line 22 but do not cross the dummy gate line 30. Also, the dummy gate line 30 is not connected with the TFTs 60 and the storage capacitors 80 such that the dummy gate line does not appear on the image display region.

When the gate lines 20 cross the data lines 40 as shown in FIG. 1, pixels 50 are defined at crossing portions. In this embodiment, in case where the display apparatus has the resolution of 1,024×768, 1,024×768 pixels 50 are arranged in a matrix configuration within the image display region 12.

Referring to FIG. 2, the TFT 60, the pixel electrode 70 and the storage capacitor 80 are formed in each pixel 50.

Figure 4:
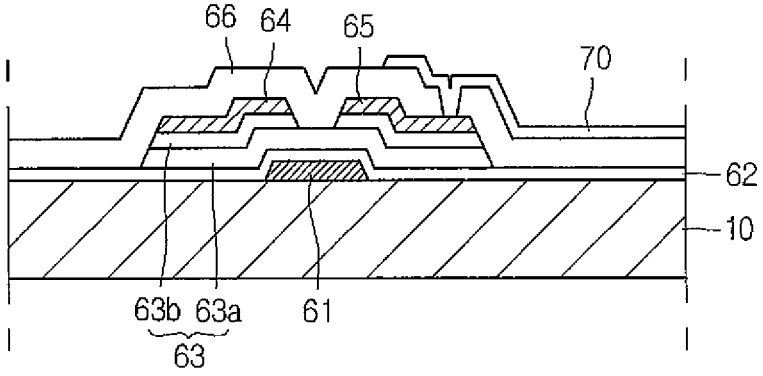
FIG. 4 is a sectional view illustrating one of pixels arranged on FIG. 1.

FIG. 4 is a sectional view illustrating one of pixels arranged on FIG. 1.

Referring to FIG. 4, the TFT 60 includes a gate electrode 6, a gate insulating layer 62, a channel layer 63, and source and drain electrodes 64 and 65.

The gate electrode 61 is formed on an upper surface of the lower substrate 10 and is connected to the gate line 20. The insulating layer 62 is disposed on the gate electrode 61 and the gate line 20 to enclose the image display region 12 including the gate electrode 61 and the gate line 20, and the peripheral region 14.

The channel layer 63 is disposed on the gate insulating layer 62. The channel layer 63 includes an amorphous silicon layer 63*a*, and an n+ amorphous silicon layer 63*b* formed on the amorphous silicon layer 63*a*. The amorphous silicon layer 63*a* on the gate insulating layer 62 is patterned to have a larger area than that of the gate electrode 61, so that the amorphous silicon layer 63*a* covers the gate electrode 61. The n+ amorphous silicon layer 63*b* is formed at the same area as the amorphous silicon layer 63*a*, and has an opening formed at a center and exposing the amorphous silicon layer 63*a*.

The source and drain electrodes 64 and 65 are formed on the n+ amorphous silicon layer 63*b*. For example, while the n+ amorphous silicon layer 63*b* is patterned, the source and drain electrodes 64 and 65 are patterned together to have the same shape as that of the n+ amorphous silicon layer 63*b*. That is, the source electrode 64 corresponds to a portion overlapping one end of the gate electrode 61 and connected with the data line 40 on the basis of the opening formed between the source electrode 64 and the drain electrode 65, and the drain electrode corresponds to a portion overlapping the other end of the gate electrode 61 and connected with the pixel electrode 70.

A passivation layer 66 is formed on the source and drain electrodes 64 and 65 to cover the TFTs 60 and the data lines 40. The pixel electrode 70 is disposed on the passivation layer 66 and is electrically connected with the drain electrode 65 via a contact hole formed at the passivation layer 66.

Referring to FIGS. 2 and 3, the storage capacitor 80 is created at a portion where two electrodes are overlapped with each other together with an insulator interposed therebetween.

Referring to FIG. 1, the gate drive unit 100 is disposed outside the lower substrate 10, is electrically connected with the gate lines 20 and the dummy gate line 30 to deliver gate signals for turning on/off the TFTs 60, and includes a gate controller 110 and a gate driver 120.

The gate controller 110 includes a printed circuit board (PCB) 112 spaced apart from the lower substrate 10 and disposed in the first direction, and a drive element 114 mounted on the PUB 112 to generate various signals including turn on voltage and turn off voltage of the TFT 60, and a control signal.

The gate driver 120 is to electrically connect the gate controller 110 with the gate lines of the lower substrate 10, and in the case of 768 gate lines, the gate driver 120 includes first to third gate drives 120*a*, 120*b*, 120*c*. In this embodiment, although the first to third gate drivers 120*a*, 120*b*, 120*c* are shown in such a configuration to connect the PCB 112 with the lower substrate 10, these drivers may be mounted directly on the lower substrate 10.

Each of the first and second gate drivers 120*a* and 120*b* includes input terminals 122 connected with the gate controller 110, output terminals 124 connected with the gate lines 20, and a semiconductor device 126 disposed between the input terminals 122 and the output terminals 124 to generate gate signals including turn-on/off voltage.

The third gate driver 120*c* includes input terminals 122*c* connected with the gate controller 110, output terminals 124*c* connected with the gate lines 20 and the dummy gate line 30, and a semiconductor device 126*c* disposed between the input terminals 122*c* and the output terminals 124*c* and connected with these input and output terminals 122*c* and 124*c* to generate gate signals including turn-on/off voltage.

In this embodiment, when the number of the gate lines is 768, the number of the output terminals 124 of each of the first and second gate drivers 120*a* and 120*b* is 256. Accordingly, the first gate driver 120*a* connects the $1^{st}$ gate line 21 to the $256^{th}$ gate line, and the second gate driver 120*b* connects the $257^{th}$ gate line to the $512^{th}$ gate line.

In the meanwhile, the number of the output terminals 124*c* of the third driver 120*c* is 257, which is one more than that of the output terminals 124 of each of the first and second gate drivers 120*a* and 120*b* is 256 due to the existence of the dummy gate line 30. Accordingly, the $513^{th}$ gate line to the $768^{th}$ gate line and the dummy gate line 30 are connected to the third gate driver 120*c*. Herein, the $257^{th}$ output terminal, which is positioned at the last of the output terminals 124*c* of the third gate driver 120*c*, is connected to the dummy gate line 30.

When the display apparatus 200 configured as such above is driven, gate signals including turn-on/off voltages for TFTs are sequentially delivered from the $1^{st}$ gate line 21 to the dummy gate line 30.

Herein, in the gate signals delivered from the $1^{st}$ gate line 21 to the $768^{th}$ gate line 22, the turn-on times of all the TFTs are equal to one another. However, in the gate signal delivered to the dummy gate line 30, the turn-on time of the TFT 60 is 1.5 times longer than that of the TFTs 60 delivered to the gate lines 20 so as to represent that the dummy gate line 30 is the last signal line.

Although the gate signal is delivered to the dummy gate line 30, since the pixel 50 including the TFT 60 and the storage capacitor 80 is not connected with the dummy gate line 30, the dummy gate line 30 does not appear on the image display region 12.

Meanwhile, since the turn-on times of the TFTs 60 delivered from the $1^{st}$ gate line 21 to the last gate line 22 are equal to one another, the charge amounts of the storage capacitors provided in the respective pixels 50 are also equal to one another. Accordingly, the brightness is uniform in the pixels 50 connected to the $1^{st}$ gate line 21 to the pixels 50 connected to the last gate line 22 throughout the image display region 12.

Embodiment 2

Figure 5:
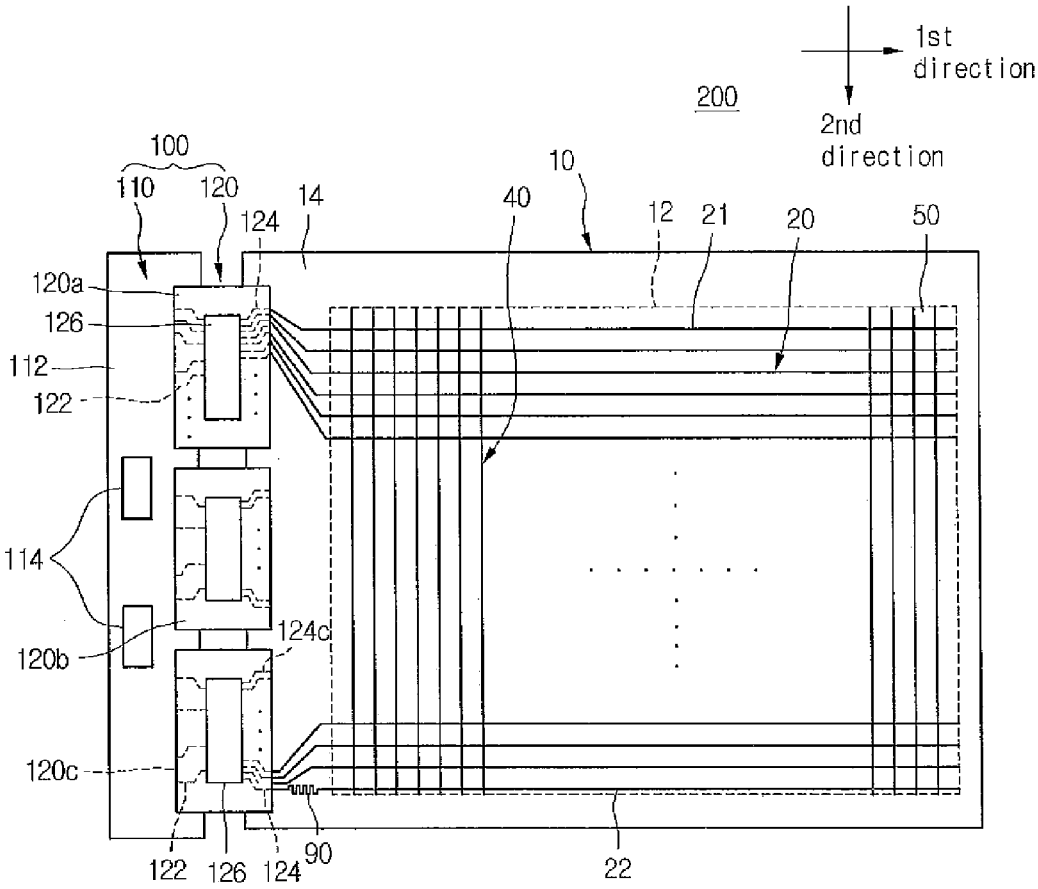
FIG. 5 is a plan view illustrating a lower substrate and a gate drive unit according to a second embodiment of the present disclosure.
Figure 6:
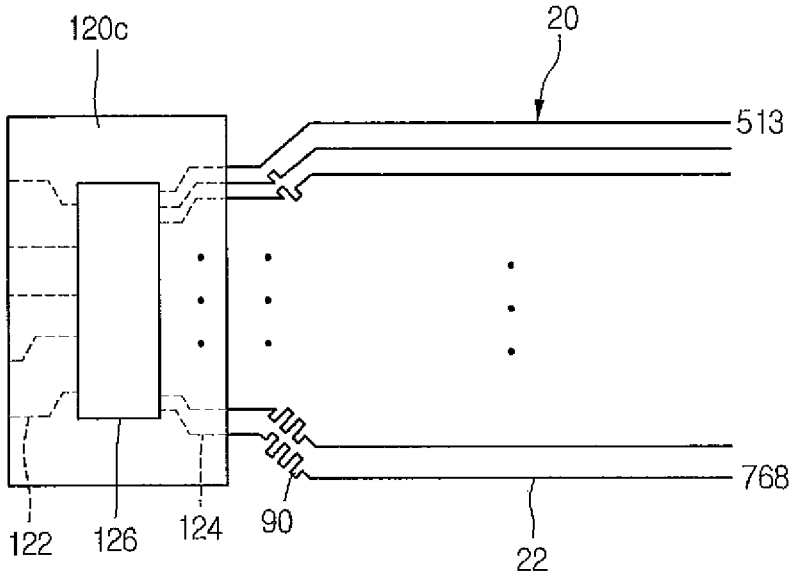
FIG. 6 is a plan view illustrating gate lines connected to a third gate driver of FIG. 5.

FIG. 5 is a plan view illustrating a lower substrate and a gate drive unit according to a second embodiment of the present disclosure, and FIG. 6 is a plan view illustrating gate lines connected to a third gate driver of FIG. 5.

A display apparatus according to the second embodiment of the present disclosure has the substantially same structure and constitution as that according to the first embodiment of the present disclosure except that the charge amounts of all storage capacitors are controlled to be equal by increasing the resistance value of the gate line arranged at the last among the gate lines or the resistance values of the gate lines connected to the third gate driver.

Referring to FIG. 5, the display apparatus 200 includes a lower substrate 10 and a gate drive unit 100. On an upper surface of the lower substrate 10, gate lines 20, data lines 40, TFTs (not shown), pixel electrodes (not shown), storage capacitors (not shown), and a resistance unit 90 are formed.

The gate lines 20 are formed in a first direction of the lower substrate 10, e.g., a horizontal direction such that they pass an entire region of the image display region 12 from the peripheral region 14. The gate lines 20 are arranged in plurality at an equal interval along a second direction of the lower substrate 10, e.g., a vertical direction. In this embodiment, when the display apparatus has the resolution of 1,024×768, 768 gate lines are arranged in parallel along the second direction of the lower substrate 10.

The data lines 40 are formed crossing the gate lines 20. The data lines 40 are formed extending in the second direction of the lower substrate 20. The data lines are arranged at an equal interval along the first direction of the lower substrate 20. In this embodiment, when the display apparatus has the resolution of 1,024×768, 1,024×3 data lines 40 are arranged in parallel.

When the gate lines 20 cross the data lines 40 as shown in FIG. 5, pixels 50 are defined at crossing portions. In this embodiment, in case where the display apparatus has the resolution of 1,024×768, 1,024×768 pixels 50 are arranged in a matrix configuration within the image display region 12.

Although not shown in FIG. 5, the TFT, the pixel electrode and the storage capacitor are formed on each pixel. Descriptions for the TFT, the pixel electrode and the storage capacitor will be omitted in this embodiment because they have the same structure and constitution as those of the first embodiment.

Referring to FIG. 5, a gate drive unit 100 is disposed outside the lower substrate 10, is electrically connected with the gate lines 20 and the resistance unit 90 to deliver gate signals for turning on/off the TFTs 60, and includes a gate controller 110 and a gate driver 120.

The gate controller 110 includes a printed circuit board (PCB) 112 spaced apart from the lower substrate 10 and disposed in the first direction, and a drive element 114 mounted on the PCB 112 to generate various signals including turn-on voltage and turn-off voltage of the TFT 60, and a control signal.

The gate driver 120 is to electrically connect the gate controller 110 with the gate lines of the lower substrate 10, and in the case of 768 gate lines, the gate driver 120 includes first to third gate drives 120*a*, 120*b*, 120*c*.

Each of the first to third gate drivers 120*a*, 120*b*, 120*c* includes input terminals 122 connected with the gate controller 110, output terminals 124 connected with the gate lines 20, and a semiconductor device 126 disposed between the input terminals 122 and the output terminals 124 to generate gate signals including turn-on/off voltage.

In this embodiment, when the number of the gate lines is 768, the number of the output terminals 124 of each of the first to third gate drivers 120*a*, 120*h*, 120*c* is 256. Accordingly, the first gate driver 120*a* connects the $1^{st}$ gate line 21 to the $256^{th}$ gate line, the second gate driver 120*h* connects the $257^{th}$ gate line to the $512^{th}$ gate line, and the third driver 120*c* connects the $513^{th}$ gate line to the $768^{th}$ gate line 22.

The resistance unit 90 is formed by patterning the gate line 20 disposed at a peripheral region 14 in a zigzag configuration, and controls the charge amounts of all the storage capacitors to be approximately equal to one another by delaying gate signals.

Referring to FIG. 5, the resistance unit 90 in this embodiment can be formed only on the last gate line 22 having a longer TFT turn-on time than other gate lines so as to represent that the resistance unit 90 is the last gate line 22.

Alternatively, referring to FIG. 6, the resistance unit 90 may be formed on all the gate lines 20 connected to the third gate driver 120*c*. The resistance unit 90 can be designed such that by finely adjusting zigzag patterns for the gate lines 20 connected to the third gate driver 120*c*, i.e., from the $513^{th}$ gate line to the $768^{th}$ gate line 22, the resistance values increase as it goes to the $768^{th}$ gate line. The resistance value of the $768^{th}$ gate line 22 is 1.5 times higher than that of the $513^{th}$ gate line.

When the display apparatus 200 configured as such above is driven, gate signals including turn-on/off voltages for TFTs are sequentially delivered from the $1^{st}$ gate line 21 to the last gate line 22.

Herein, in the gate signals delivered from the $1^{st}$ gate line 21 to the $768^{th}$ gate line 22, the turn-on times of all the TFTs are equal to one another. However, the turn-on time of the TFT 60 in the gate signal delivered to the $768^{th}$ gate line 22 is 1.5 times longer than that of the TFTs 60 delivered to other gate lines 20 so as to represent that the $768^{th}$ gate line 22 is the last signal line.

However, since the resistance value of the $768^{th}$ gate line 22 is 1.5 times higher than those of the remaining gate lines 20 due to the existence of the resistance unit 90, the gate signal delivered to each TFT is necessarily delayed. Owing to this delay, the charge amounts of the storage capacitors connected to the $768^{th}$ gate line 22 are approximately equal to those of the remaining storage capacitors connected to the remaining gate lines. Accordingly, the brightness is uniform in the pixels 50 connected to the $1^{st}$ gate line 21 to the pixels 50 connected to the last gate line 22 throughout the image display region 12.

Embodiment 3

Figure 7:
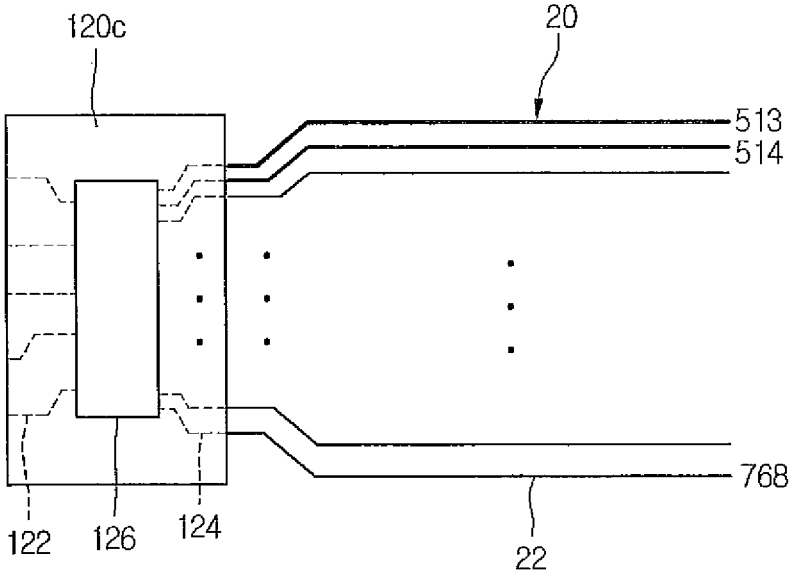
FIG. 7 is a plan view illustrating only gate lines connected to a third gate driver according to a third embodiment of the present disclosure.

FIG. 7 is a plan view illustrating only gate lines connected to a third gate drive according to a third embodiment of the present disclosure.

A display apparatus according to the third embodiment of the present disclosure has the substantially same structure and constitution as that according to the second embodiment of the present disclosure except that the width sizes of gate lines connected to the last gate line or to the third gate driver are decreased to increase the resistance values of the gate lines. Accordingly, only the gate lines connected to the third gate driver will be described in detail.

Referring to FIG. 7, in the display apparatus 200 according to this embodiment, the gate lines 20 are formed in a first direction of the lower substrate 10, e.g., a horizontal direction such that they pass an entire region of the image display region 12 from the peripheral region 14. The gate lines 20 are arranged in plurality at an equal interval along a second direction of the lower substrate 10, e.g., a vertical direction. In this embodiment, when the display apparatus has the resolution of 1,024×768, 768 gate lines are arranged in parallel along the second direction of the lower substrate 10.

Since the turn-on time of a TFT connected to the last gate line 22 is longer than the turn-on times of TFTs connected to the remaining gate lines, the charge amount of a storage capacitor connected to the last gate line 22 is also greater than the charge amounts of storage capacitors connected to other gate lines. Thus, when the charge amounts of the storage capacitors are different from each other, the pixels having the storage capacitors having a greater charge amount than other capacitors in an image display region 12 are viewed brighter. To prevent this, the width size of the last gate line 22 is made smaller than the width sizes of other gate lines such that the resistance value of the last gate line 22 is 1.5 times higher than that of other gate lines 20.

Alternatively, the width sizes of the gate lines connected to the third gate driver 120*c* are finely decreased. In other words, the width size of the $513^{th}$ gate line is made equal to that of other gate line 20 disposed above the $513^{th}$ gate line 20 but the width sizes of the gate lines from the $514^{th}$ gate lines are finely adjusted to be gradually decreased such that the resistance values of the gate lines increase as it goes from the $513^{th}$ gate line to the $768^{th}$ gate line 22. The resistance value of the $768^{th}$ gate line 22 is 1.5 times higher than that of the $513^{th}$ gate line.

When the display apparatus 200 configured as such above is driven, gate signals including turn-on/off voltages for TFTs are sequentially delivered from the $1^{st}$ gate line 21 to the last gate line 22.

Herein, in the gate signals delivered from the $1^{st}$ gate line 21 to the $768^{th}$ gate line 22, the turn on times of all the TFTs are equal to one another. However, the turn-on time of the TFT 60 in the gate signal delivered to the $768^{th}$ gate line 22 is 1.5 times longer than that of the TFTs 60 delivered to other gate lines 20 so as to represent that the $768^{th}$ gate line 22 is the last signal line.

However, since the width size of the $768^{th}$ gate line 22 is decreased such that the resistance value of the $768^{th}$ gate line 22 is 1.5 times higher than those of the remaining gate lines 20, the gate signal delivered to each TFT connected to the $768^{th}$ gate line 22 is necessarily delayed. Owing to this delay, the charge amounts of the storage capacitors connected to the $768^{th}$ gate line 22 are approximately equal to those of the remaining storage capacitors connected to the remaining gate lines. Accordingly, the brightness is uniform in the pixels 50 connected to the $1^{st}$ gate line 21 to the pixels 50 connected to the last gate line 22 throughout the image display region 12.

As described above, a dummy gate line is formed below the last gate line, or the last gate line is designed such that the resistance value thereof is 1.5 times higher than those of other gate lines, to prevent a phenomenon that the pixels connected to the last gate line are viewed brighter than those connected to the remaining gate lines, thereby improving the brightness uniformity.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display apparatus comprising:

a substrate on which a display region and a non-display region are defined;

the display region having a plurality of pixels defined by a plurality of gate lines and a plurality of data lines crossing each other, and including a thin film transistor, a pixel electrode disposed on each pixel, and a common electrode;

the non-display region having a dummy gate line, and a gate drive unit for applying a gate signal to the plurality of gate lines and the dummy gate line, wherein the dummy gate line is disposed away from the plurality of data lines, wherein a turn-on time of a switch coupled to the dummy gate line is longer than a turn-on time of a switch coupled to the plurality of gate lines, and wherein the dummy gate line is disposed under a last gate line of the plurality of gate lines, and a high period of the gate signal supplied to the dummy gate line is longer than a high period of the gate signal supplied to the plurality of gate lines, wherein the dummy gate line does not cross the plurality of data lines.

2. The display apparatus according to claim 1, wherein a turn-on time of the thin film transistor connected to the dummy gate line is 1.5 times longer than that of the thin film transistor connected to the gate lines.

3. The display apparatus according to claim 1, wherein the gate drive unit comprises at least first and second gate drivers, and the number of output terminals of the first gate driver is lower than the number of output terminals of the second gate driver.

4. The display apparatus according to claim 3, wherein the first and second gate drivers are configured in a structure connecting a printed circuit board on which a gate controller is mounted, to the substrate, or are mounted on the substrate.

5. The display device according to claim 1, wherein storage capacitors of the pixels connected to the plurality of gate lines have the same charge amount.

6. The display device according to claim 1, further comprising a color filter substrate disposed corresponding to the display region of the substrate.

7. The display device according to claim 1, wherein an edge of the plurality of data lines is disposed between the dummy gate line and the last gate line of the plurality of gate lines.

* * * * *